US011810455B2

(12) United States Patent
Ma et al.

(10) Patent No.: US 11,810,455 B2
(45) Date of Patent: Nov. 7, 2023

(54) URBAN TUNNEL VARIABLE LANE DIVIDING LINE CONTROL METHOD

(71) Applicant: NANJING FORESTRY UNIVERSITY, Nanjing (CN)

(72) Inventors: Jianxiao Ma, Nanjing (CN); Song Fang, Nanjing (CN); Tao Lu, Nanjing (CN)

(73) Assignee: NANJING FORESTRY UNIVERSITY

( * ) Notice: Subject to any disclaimer, the term of this patent is extended or adjusted under 35 U.S.C. 154(b) by 416 days.

(21) Appl. No.: 17/296,923

(22) PCT Filed: Jun. 15, 2020

(86) PCT No.: PCT/CN2020/096209
§ 371 (c)(1),
(2) Date: May 25, 2021

(87) PCT Pub. No.: WO2020/216384
PCT Pub. Date: Oct. 29, 2020

(65) Prior Publication Data

US 2022/0292957 A1 Sep. 15, 2022

(30) Foreign Application Priority Data

Apr. 23, 2019 (CN) ..... 201910330979.1

(51) Int. Cl.
*G08G 1/08* (2006.01)
*G08G 1/04* (2006.01)
*G08G 1/052* (2006.01)

(52) U.S. Cl.
CPC ..... *G08G 1/08* (2013.01); *G08G 1/04* (2013.01); *G08G 1/052* (2013.01)

(58) Field of Classification Search
CPC ..... G08G 1/08; G08G 1/04; G08G 1/052
USPC ..... 701/118
See application file for complete search history.

(56) References Cited

FOREIGN PATENT DOCUMENTS

| | | | |
|---|---|---|---|
| CN | 101363575 A | * | 2/2009 |
| CN | 204288520 | | 4/2015 |
| CN | 105279979 | | 1/2016 |
| CN | 105825687 | | 8/2016 |

(Continued)

*Primary Examiner* — Isaac G Smith
(74) *Attorney, Agent, or Firm* — Jose Cherson Weissbrot

(57) ABSTRACT

An urban tunnel variable lane dividing line control method, comprising: setting a distance between adjacent infrared detection apparatuses, and arranging a number n of infrared detection apparatuses side by side directly above the center of a lane of an urban tunnel; when a certain infrared detection apparatus in the urban tunnel detects a passing vehicle signal, extending the travelling direction, and if a number a of adjacent infrared detection apparatuses further along the travelling direction do not detect a passing vehicle signal within a time t, determining that the vehicle is a very slow vehicle, and changing a number m of LED indication lights which are fully illuminated to be illuminated at intervals. The urban tunnel variable lane dividing line control method can determine whether a very slow vehicle is present in a lane, and adjust a display state of a lane dividing line in an urban tunnel in real time, thereby increasing urban tunnel traffic efficiency, and preventing very slow vehicles from affecting urban tunnel traffic capacity.

5 Claims, 1 Drawing Sheet

(56) References Cited

FOREIGN PATENT DOCUMENTS

| | | | | |
|---|---|---|---|---|
| CN | 105839557 | | | 8/2016 |
| CN | 105839557 | A | * | 8/2016 |
| CN | 108824251 | | | 11/2018 |
| CN | 108842652 | | | 11/2018 |
| CN | 110060487 | | | 7/2019 |
| JP | 11345396 | | | 12/1999 |

* cited by examiner

URBAN TUNNEL VARIABLE LANE DIVIDING LINE CONTROL METHOD

FIELD OF THE INVENTION

The present invention relates to an urban tunnel facility, in particular to an urban tunnel variable lane dividing line control method.

BACKGROUND OF THE INVENTION

At present, with economic development and social progress, the urban population has increased and the number of cars has continued to increase. The capacity of many urban tunnels has been unable to meet the increasing traffic demand, and traffic jam and congestion have become more and more serious. In addition to the increase in the number of cars exceeding the limit of the urban tunnel, the very slow vehicle in the urban tunnel is also one of the reasons for the insufficient capacity of the urban tunnel.

With the continuous development of intelligent transportation inventions, intelligent control inventions are used to intelligently adjust the lane dividing line of urban tunnels, which can maximize the use of urban tunnel section resources to solve the problem of insufficient capacity of the urban tunnel caused by the very slow vehicle in the urban tunnel.

SUMMARY OF THE INVENTION

The invention problem to be solved by the present invention is to provide an urban tunnel variable lane dividing line control method for the above-mentioned shortcomings of the existing invention. The urban tunnel variable lane dividing line control method can determine whether there is a very slow vehicle on the road and adjust the urban tunnel in real time. The display state of the lane dividing line inside improves the traffic efficiency of the urban tunnel and avoids the influence of very slow vehicles on the traffic capacity of the urban tunnel. The urban tunnel variable lane dividing line control method can determine whether a very slow vehicle is present in a lane, and adjust a display state of a lane dividing line in an urban tunnel in real time, thereby increasing urban tunnel traffic efficiency, and preventing very slow vehicles from affecting urban tunnel traffic capacity.

In order to achieve the above-mentioned purpose of the present invention, the present invention scheme adopted by the present invention is as follows:

an urban tunnel variable lane dividing line control method, comprising:

a number n of infrared detection apparatuses and a lane dividing line formed by a number m of LED indication lights arranged in sequence, the number n of infrared detection apparatuses are arranged directly above a center of the lane of the urban tunnel, when the number m of LED indication lights are all illuminated, the lane dividing line is a white solid line, and when the number m of LED indication lights are illuminated at intervals, the lane dividing line is a white dashed line, the control method includes the following steps:

step 1: setting a distance L between adjacent infrared detection apparatuses, and arranging the number n of infrared detection apparatuses side by side directly above the center of the lane of the urban tunnel according to the distance L;

step 2: when a certain infrared detection apparatus in the urban tunnel detects a passing vehicle signal, extending the travelling direction, and if a number a of adjacent infrared detection apparatuses further along the travelling direction do not detect a passing vehicle signal within a time t, determining that the vehicle is a very slow vehicle, and going to step 3; otherwise, all the number m of LED indication lights will remain illuminated and lane change being prohibited; and step 3: changing the number m of LED indication lights which are fully illuminated to be illuminated at intervals, that is, changing the white solid line into a white dashed line, allowing lane change and overtaking.

As a further improvement of the present invention, the time t in step 2 should satisfy:

$$\frac{L-I_m}{v/3.6} < t < \frac{L-I_m}{v_m/3.6}; \tag{1}$$

wherein, $v_m$ is the driving speed of the very slow vehicle (km/h), $I_m$ is the body length (m), v is the normal driving speed of the vehicle (km/h).

As a further improvement of the present invention, the distance L is 10 m, the number n of the infrared detection apparatuses are $X_1, X_2, X_3 \ldots X_i \ldots X_{n-1}$, the step 2 is specifically:

when a certain infrared detection apparatus $X_i$ in the urban tunnel detects a passing vehicle signal, extending the travelling direction, and if adjacent $X_{i+1}, X_{i+2}, X_{i+3}, X_{i+4}, X_{i+5}$ further along the travelling direction do not detect a passing vehicle signal within a time t, determining that the vehicle is a very slow vehicle, and executing step 3; otherwise, all the number m of LED indication lights will remain illuminated and lane change being prohibited.

As a further improvement of the present invention, a length of each of the LED indication lights is 400 cm and a width is 15 cm.

As a further improvement of the present invention, the infrared detection apparatus and the lane dividing line formed by the number m of the LED indication lights arranged in sequence are both set in a middle section of the urban tunnel.

The beneficial effects of the present invention are: the control method of the present invention can judge whether there is a very slow vehicle on the road, and adjust the display state of the lane dividing line in the urban tunnel in real time according to the judgment result. If there is a very slow vehicle, the lane dividing line can be changed to a white dashed line, allowing vehicles to change lanes and overtaking, improving the traffic efficiency of the tunnel, and avoiding the impact of the very slow vehicle on the tunnel traffic capacity as much as possible.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE INVENTION

Figure 1:
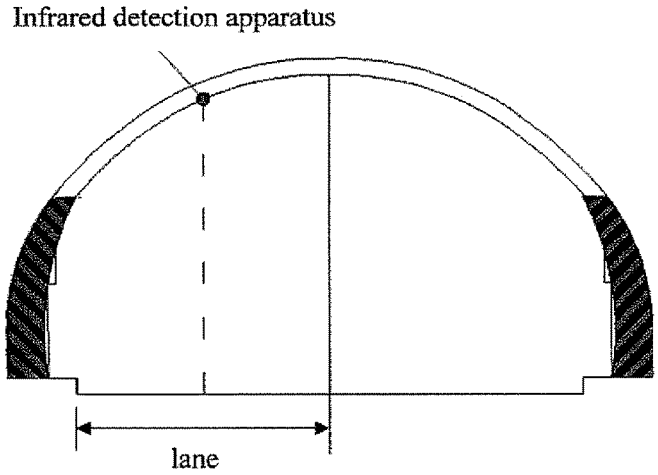
FIG. 1 is a three-dimensional layout diagram of an infrared detection apparatus of this embodiment.
Figure 2:
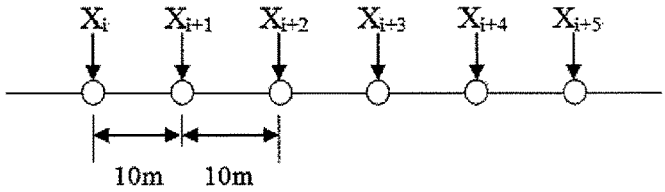
FIG. 2 is a longitudinal layout diagram of part of an infrared detection apparatus of this embodiment.
Figure 3:
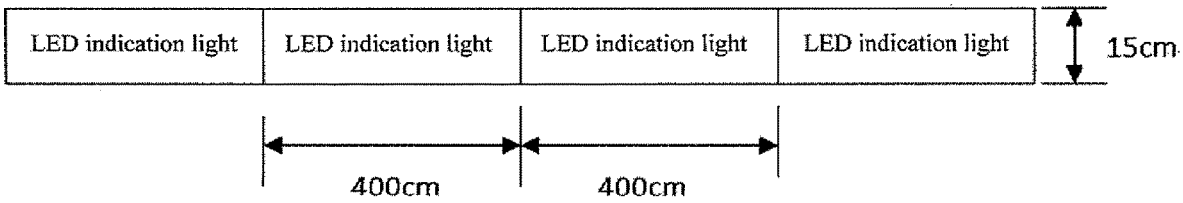
FIG. 3 is a longitudinal layout diagram of a LED indication light in this embodiment.

The specific embodiments of the present invention will be further described below based on FIGS. 1 to 3.

This embodiment is mainly divided into two parts, one part is to arrange the infrared detection apparatus above the lane, the main purpose is to determine whether the driving vehicle is a very slow vehicle, and the other part is the lane dividing line with variable markings.

Normally, the lane dividing line is displayed as a solid white line, and overtaking is prohibited; when the system determines that there is a very slow vehicle, it is displayed as a white dashed line, allowing the vehicle to change lanes and overtake. The solution of this embodiment will be described in detail below.

This embodiment provides an urban tunnel variable lane dividing line control method, comprising: a number n of infrared detection apparatuses and a lane dividing line formed by a number m of LED indication lights arranged in sequence, and the lane dividing line is a lane dividing line with variable marking. When the number m of LED indication lights are all illuminated, the lane dividing line is a white solid line, and when the number m of LED indication lights are illuminated at intervals, the lane dividing line is a white dashed line, wherein the number n of infrared detection apparatuses are arranged directly above a center of the lane of the urban tunnel, the number n of the infrared detection apparatuses are respectively marked $X_1.X_2.X_3 \ldots X_i \ldots X_{n-1}$.

The control method of this embodiment includes the following steps:

(1.1) The infrared detection apparatuses are arranged side by side directly above the center of the lane of the urban tunnel, and each time a car passes on the lane, the infrared detection apparatuses will receive a signal value. Set the distance L between adjacent infrared detection apparatuses, and arrange the number n of infrared detection apparatuses side by side directly above the center of the lane of the urban tunnel according to the distance L. The distance L in this embodiment takes the value of the minimum distance between the heads of the vehicle, calculated according to the design speed, and can be appropriately increased and rounded to facilitate construction, and the value can be 10 m, and the layout is shown in FIGS. 1 and 2.

(1.2) When a certain infrared detection apparatus in the urban tunnel detects a passing vehicle signal, extending the travelling direction, and if the number a of adjacent infrared detection apparatuses further along the travelling direction do not detect a passing vehicle signal within a time t, determining that the vehicle is a very slow vehicle, changing the number m of LED indication lights which are fully illuminated to be illuminated at intervals, that is, changing the white solid line into a white dashed line, allowing lane change and overtaking, otherwise, all the number m of LED indication lights will remain illuminated and lane change being prohibited.

In order to ensure the safety of tunnel traffic, when the very slow vehicle enters the middle section of the tunnel and the distance from the front of the vehicle reaches 50 m, adjust the display state of the lane dividing line. Based on this, the number a in this embodiment is set to 5, that is, when a certain infrared detection apparatus $X_i$ in the urban tunnel detects a passing vehicle signal, extending the travelling direction, and if adjacent $X_{i+1}.X_{i+2}.X_{i+3}.X_{i+4}.X_{i+5}$ further along the travelling direction do not detect a passing vehicle signal within a time t, determining that the vehicle is a very slow vehicle. In this embodiment, when a very slow vehicle is not detected, the white solid line state is maintained, if it was a white dashed line before, the white dashed line needs to be changed into a white solid line.

The setting of time tin this embodiment should mainly consider system misjudgment. For example, when the infrared detection apparatus Xi detects a passing vehicle at a certain moment, there is a motor vehicle at a distance of 50 m in front, but it is located in the middle of the two infrared detection apparatuses, therefore, the preceding vehicle is not detected at this moment. Therefore the time t should satisfy:

$$\frac{L - l_m}{v/3.6} < t < \frac{L - l_m}{v_m/3.6}; \quad (1)$$

wherein, $v_m$ is the driving speed (km/h) of the very slow vehicle, $l_m$ is the body length (m), v is the normal driving speed (km/h) of the vehicle. In this embodiment, the value of L is 10 m, the normal driving speed of the vehicle is 60 km/h, the driving speed of the very slow vehicle is 40 km/h, and the length of the vehicle body is 4 m, and the value of t is 0.5 s when substituted into the calculation.

The lane dividing line in this embodiment is a variable marking line. Normally, the lane dividing line in the tunnel is a white solid line, that is, lane change and overtaking are prohibited. When the system detects the target very slow vehicle, the lane dividing line becomes a white dashed line, allowing vehicles behind to change lanes and overtaking, and avoiding the impact of the very slow vehicle on the tunnel traffic capacity as much as possible. Based on this function, this embodiment designs the lane dividing line as a white LED light box type. The size refers to the provisions of "Road Traffic Signs and Markings" (GB5768). Each LED light box (i.e., the above-mentioned LED indication light) has a length of 400 cm, and the width is 15 cm (as shown in FIG. 3). Normally, the LED light box is in full light state, that is, it displays a white solid line state, and lane change and overtaking are prohibited, when the system is started, the LED light box is in an interval lighting state, that is, it displays a white dashed solid line state, allowing lane change and overtaking.

The infrared detection apparatus of this embodiment and the lane dividing line formed by the number m of the LED indication lights arranged in sequence are both set in a middle section of the urban tunnel.

According to the above-mentioned method of this embodiment and according to the number of lanes in the urban tunnel, the number n of infrared detection apparatuses can be installed side by side directly above the required lanes and a lane dividing line with variable markings can be set on the lane dividing line corresponding to the lane. Both the infrared detection apparatus and the LED indication light of this embodiment are connected with a power supply system and a control system, the power supply system is used to supply power for the infrared detection apparatus and the LED indication light in real time, the control system is used to receive and analyze the signal of the infrared detection apparatus in real time, so as to adjust the lighting state of the LED indication light in real time.

This embodiment adjusts the display state of the lane dividing line in an urban tunnel in real time according to whether a very slow vehicle is present on a lane, thereby increasing urban tunnel traffic efficiency, and preventing very slow vehicles from affecting urban tunnel traffic capacity.

The scope of protection of the present invention includes, but is not limited to, the above-mentioned embodiments. The scope of protection of the present invention is subject to the claims. Any substitutions, modifications, and improvements that can be easily conceived by those skilled in the art made to the present invention fall within the scope of protection of the present invention.

What is claimed and desired to be protected by Letters Patent is:

1. An urban tunnel variable lane dividing line control method, comprising:

a number n of infrared detection apparatuses and a lane dividing line formed by a number m of LED indication lights arranged in sequence, the number n of infrared detection apparatuses are arranged directly above a center of the lane of the urban tunnel, when the number m of LED indication lights are all illuminated, the lane dividing line is a white solid line, and when the number m of LED indication lights are illuminated at intervals, the lane dividing line is a white dashed line;

the control method includes the following steps:

step 1: setting a distance L between adjacent infrared detection apparatuses, and arranging the number n of infrared detection apparatuses side by side directly above the center of the lane of the urban tunnel according to the distance L;

step 2: when a certain infrared detection apparatus in the urban tunnel detects a passing vehicle signal, extending the travelling direction, and if a number a of adjacent infrared detection apparatuses further along the travelling direction do not detect a passing vehicle signal within a time t, determining that the vehicle is a very slow vehicle, and going to step 3; otherwise, all the number m of LED indication lights will remain illuminated and lane change being prohibited; and step 3: changing the number m of LED indication lights which are fully illuminated to be illuminated at intervals, that is, changing the white solid line into a white dashed line, allowing lane change and overtaking.

2. The urban tunnel variable lane dividing line control method according to claim 1, wherein:

the time t in step 3 should satisfy:

$$\frac{L-l_m}{v/3.6} < t < \frac{L-l_m}{v_m/3.6}; \quad (1)$$

wherein, $v_m$ is the driving speed (km/h) of the very slow vehicle, $l_m$ is the body length (m), v is the normal driving speed (km/h) of the vehicle.

3. The urban tunnel variable lane dividing line control method according to claim 1, wherein:

the distance L is 10 m, the number n of the infrared detection apparatuses are respectively marked $X_1$, $X_2$, $X_3 \ldots X_i \ldots X_{n-1}$;

the step 2 is specifically:

when a certain infrared detection apparatus $X_i$ in the urban tunnel detects a passing vehicle signal, extending the travelling direction, and if adjacent $X_{i+1}$, $X_{i+2}$, $X_{i+3}$, $X_{i+4}$, $X_{i+5}$ further along the travelling direction do not detect a passing vehicle signal within a time t, determining that the vehicle is a very slow vehicle, and executing step 3, otherwise, all the number m of LED indication lights will remain illuminated and lane change being prohibited.

4. The urban tunnel variable lane dividing line control method according to claim 1, wherein:

a length of each of the LED indication lights is 400 cm and a width is 15 cm.

5. The urban tunnel variable lane dividing line control method according to claim 1, wherein the infrared detection apparatus and the lane dividing line formed by the number m of the LED indication lights arranged in sequence are both set in a middle section of the urban tunnel.

* * * * *